US007914292B2

(12) United States Patent
Honda

(10) Patent No.: US 7,914,292 B2
(45) Date of Patent: Mar. 29, 2011

(54) ELECTRIC PLUG AND METHOD OF PROVIDING THE SAME

(75) Inventor: Dale T. Honda, Torrance, CA (US)

(73) Assignee: Belkin International, Inc., Playa Vista, CA (US)

( * ) Notice: Subject to any disclaimer, the term of this patent is extended or adjusted under 35 U.S.C. 154(b) by 0 days.

(21) Appl. No.: 12/581,110

(22) Filed: Oct. 16, 2009

(65) Prior Publication Data

US 2010/0130026 A1 May 27, 2010

Related U.S. Application Data

(60) Provisional application No. 61/106,071, filed on Oct. 16, 2008, provisional application No. 61/240,988, filed on Sep. 9, 2009.

(51) Int. Cl.
*H01R 39/00* (2006.01)

(52) U.S. Cl. ..... 439/21

(58) Field of Classification Search ..... 439/21, 439/11, 694, 310, 484, 20, 135, 22, 10, 466, 439/169

See application file for complete search history.

(56) References Cited

U.S. PATENT DOCUMENTS

| | | | | |
|---|---|---|---|---|
| 4,702,537 | A | 10/1987 | Mattingly et al. | |
| 4,773,866 | A | 9/1988 | Basques | |
| 5,399,093 | A * | 3/1995 | Schneider et al. | 439/21 |
| 5,403,202 | A | 4/1995 | Roehling | |
| 5,595,503 | A | 1/1997 | Pittman et al. | |
| 5,775,921 | A * | 7/1998 | Chou | 439/21 |
| 7,238,028 | B2 * | 7/2007 | Gerard | 439/21 |
| 7,566,223 | B2 * | 7/2009 | Wadsworth | 439/21 |

* cited by examiner

*Primary Examiner* — Edwin A. Leon
(74) *Attorney, Agent, or Firm* — Bryan Cave LLP

(57) ABSTRACT

Embodiments of a rotatable electric plug and related methods are described herein. Other embodiments and related methods are also disclosed herein.

20 Claims, 8 Drawing Sheets

ELECTRIC PLUG AND METHOD OF PROVIDING THE SAME

CROSS REFERENCE TO RELATED APPLICATION

This application claims priority to U.S. Provisional Patent Application 61/106,071, filed on Oct. 16, 2008, and U.S. Provisional Patent Application No. 61/240,988, filed on Sep. 9, 2009; the contents of both applications are incorporated herein by reference.

FIELD OF THE INVENTION

The present invention relates generally to an electrical plug and, more particularly, to an electrical plug having a low profile housing and a rotatable electrical cord.

BACKGROUND

Conventional electrical plugs can be undesirable because they typically include a housing designed to protrude a substantial distance from the outlet surface, such as, for example a wall when the plug is inserted into a wall outlet contained with the wall. This protrusion causes the plug to be susceptible to unintentional disengagement by: objects moving near the wall outlet, such as, for example persons or objects a person may be carrying; objects being placed close to the wall, such as, for example furniture, computing equipment, consumer electronics and the like; or any such other objects that may come into close proximity to a wall outlet.

Many varieties of electrical plugs have been developed which have low profile housings. These electrical plugs with low profile housings are advantageous because they have a reduced housing profile in comparison to conventional electrical plugs. As such, electrical plugs with low profile housings can be less susceptible to unintentional disengagement and may permit objects to be placed closer to a wall outlet, and therefore its associated wall, than is possible with conventional plugs.

Most electrical plugs with low profile housings include a power cord that exits the plug perpendicular to the prongs of the plug so as to decrease the profile of plug's housing. Therefore, when the plug is inserted into a wall outlet, the power cord exits the plug housing parallel to the face of the wall outlet. Unfortunately, this configuration may prove undesirable because it is possible for the cord to block other receptacles in the outlet after it exits the low profile housing. Blocking receptacles prevents additional plugs from being inserted into the outlet. This is even more of a problem with polarized plugs or plugs incorporating a ground prong since these plugs can only be inserted into the wall outlet in a single orientation.

Therefore, a need exists in the art to develop electrical plugs with low profile housings and related methods thereto that address such limitations of the current technology.

BRIEF DESCRIPTION OF THE DRAWINGS

The invention will be better understood from a reading of the following detailed description of examples of embodiments, taken in conjunction with the accompanying figures in the drawings in which.

Figure 1:
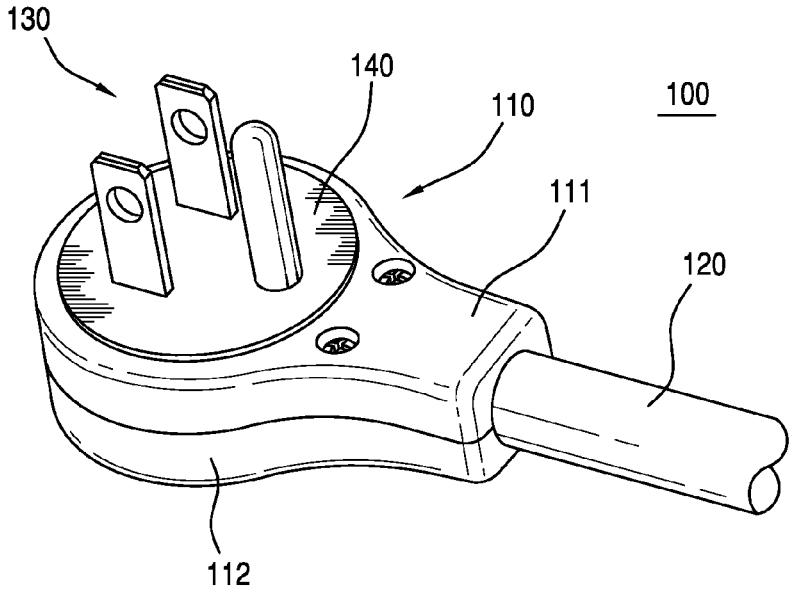
FIG. 1 illustrates an isometric top view of an embodiment of an exemplary rotatable electric plug in accordance with the present disclosure, in accordance with the subject matter described herein.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements or signals, electrically, mechanically or otherwise. Two or more electrical elements may be electrically coupled, but not mechanically or otherwise coupled; two or more mechanical elements may be mechanically coupled, but not electrically or otherwise coupled; two or more electrical elements may be mechanically coupled, but not electrically or otherwise coupled. Coupling (whether mechanical, electrical, or otherwise) may be for any length of time, e.g., permanent or semi-permanent or only for an instant.

"Electrical coupling" and the like should be broadly understood and include coupling involving any electrical signal, whether a power signal, a data signal, and/or other types or combinations of electrical signals. "Mechanical coupling" and the like should be broadly understood and include mechanical coupling of all types. The absence of the word "removably," "removable," and the like near the word "coupled," and the like does not mean that the coupling, etc. in question is or is not removable.

DETAILED DESCRIPTION

In one embodiment, a rotatable electric plug includes a housing, a contact support subassembly, a contact array, a blade array, a rotation plate, and a power cord. The housing can include a top piece having an interior surface and an exterior surface and including a first opening. The housing also can include a bottom piece having an interior surface and an exterior surface, where the bottom piece is in mechanical communication with the top piece. A first cavity can be defined by the interior surface of the top piece and the interior surface of the bottom piece, the first cavity including a second opening. The contact support subassembly can have a top surface and a bottom surface and can be located within the first cavity. The contact support subassembly also can have a third opening in communication with the bottom surface. The contact support subassembly can be mechanically coupled to the interior surface of the bottom piece and can form a second cavity in communication with the third opening. The top of the contact support subassembly can include a plurality of contact support subassembly slots. The contact array can be in mechanical communication with the top surface of the contact support subassembly, and the contact array can include a plurality of concentric contacts. Each one of the plurality of concentric contacts can include a tab passing through an associated one of the plurality of contact support subassembly slots. The blade array can be in slidable communication with the contact array, and the blade array can include a plurality of blades. Each blade of the plurality of blades can be in electrical communication with an associated one of the plurality of concentric contacts of the contact array. The rotation plate can have a top surface and a bottom surface, where the top surface of the rotation plate is sized to fit within the first opening. The rotation plate can include a plurality of rotation slots, where each rotation slot of the plurality of rotation slots is sized to receive an associated one of the plurality of blades of the blade array. The power cord can be configured to pass through the second opening into the first cavity and to further pass through the third opening into the second cavity. The power cord can have a plurality of wires, where each wire of the plurality of wires is configured to mechanically couple to and be in electrical communication with an associated one of the tabs of the plurality of concentric contacts.

Turning to the drawings, FIG. 1 illustrates an isometric top view of an embodiment of an exemplary rotatable electric plug system 100 in accordance with one embodiment of the subject matter described herein. System 100 is merely exemplary and is not limited to embodiments presented herein. System 100 can be implemented in many different embodiments or examples not presented herein. In FIG. 1, rotatable electric plug system 100 includes rotatable electric plug head 110 and power cable 120. Rotatable electric plug head 110 includes a top housing 111, a bottom housing 112 in mechanical communication with top housing 111 and a rotatable plug assembly 130. Rotatable plug assembly 130 includes rotation plate 140 and blade array 150 (as see in FIGS. 3, 5 and 6).

In operation, top housing 111 and bottom housing 112 are mechanically coupled together and form a cavity wherein each of the wires contained within power cable 120 is in electrical communication with an associated blade of blade array 150 (detailed below). Furthermore, rotation plate 140 is in rotatable communication with a portion of top housing 111 and includes an associated slot for each blade of blade array 150, thereby allowing blade array to be placed into electrical communication with an associated electrical socket. Because rotation plate 140 is in rotatable communication with housing 111, blade array 150 can be rotated to substantially any position required to interface with the aforementioned electric socket (detailed below).

Figure 2:
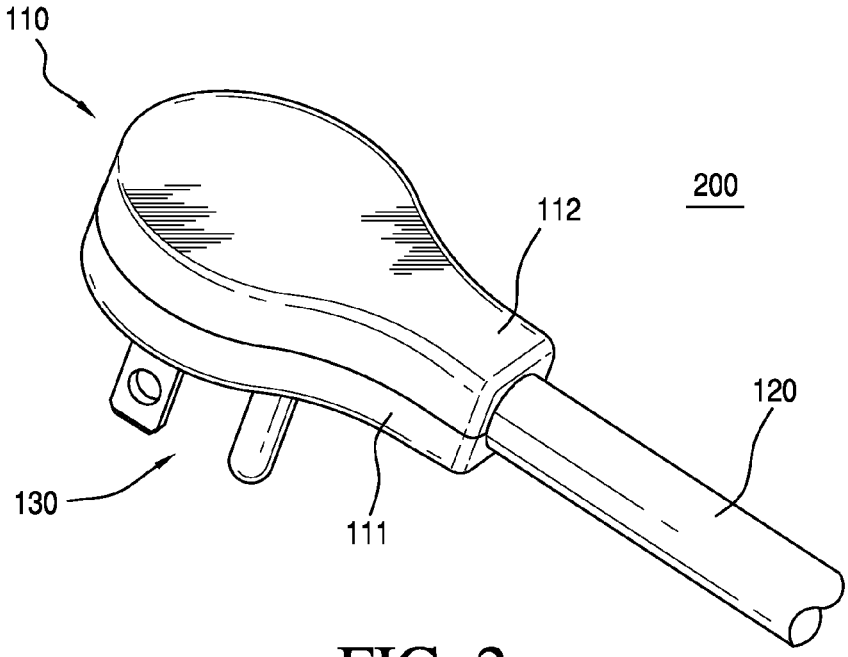
FIG. 2 illustrates an isometric bottom view of the exemplary rotatable electric plug of FIG. 1, in accordance with the subject matter described herein.

FIG. 2 illustrates an isometric bottom view of an embodiment of an exemplary rotatable electric plug system 200 in accordance with one embodiment of the subject matter described herein. System 200 is merely exemplary and is not limited to embodiments presented herein. System 200 can be implemented in many different embodiments or examples not presented herein. In FIG. 2, rotatable electric plug system 200 includes rotatable electric plug head 110 and power cable 120. Elements numbered as in FIG. 1 function in a substantially similarly way.

Figure 3:
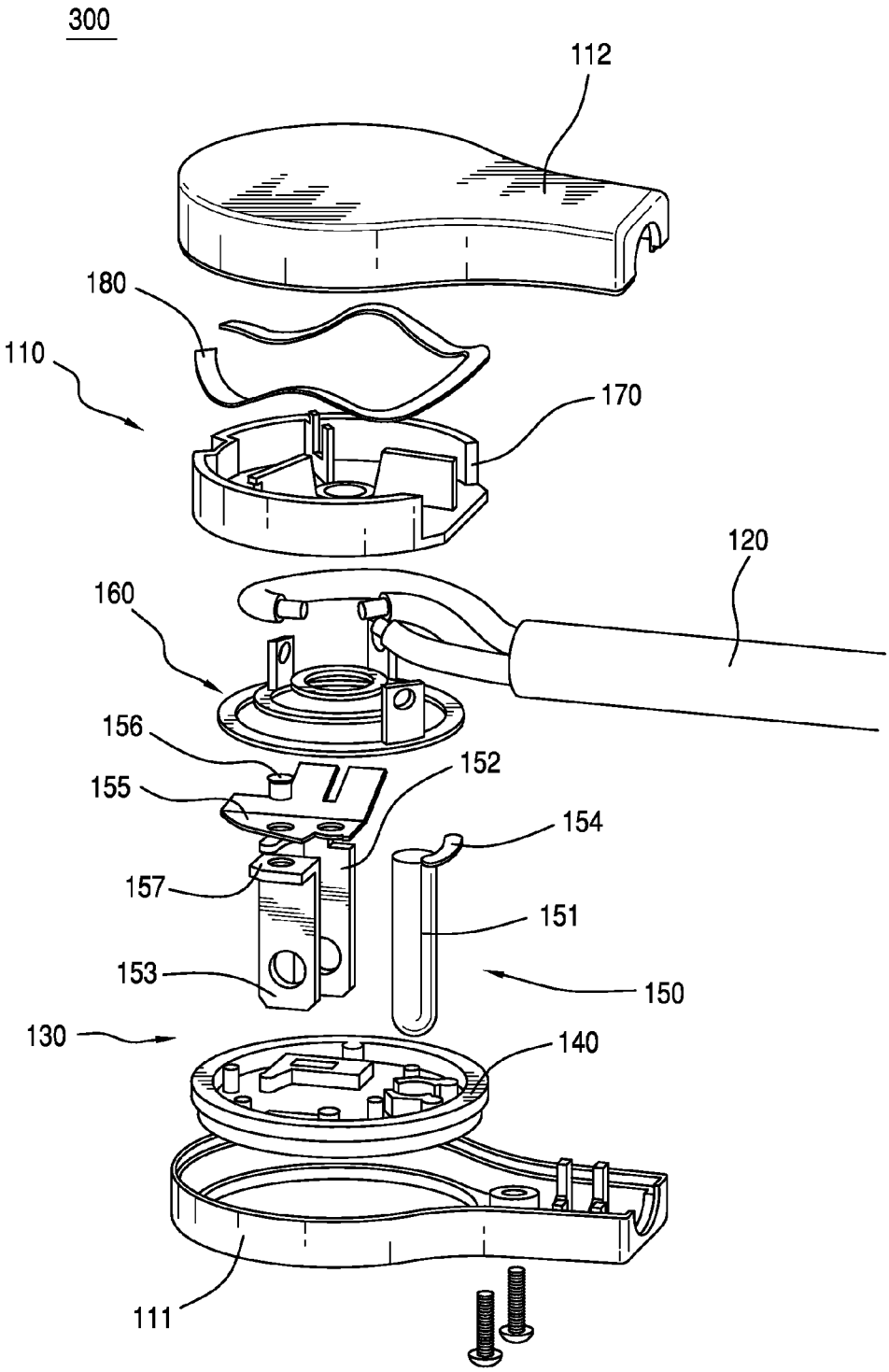
FIG. 3 illustrates an isometric exploded left side view of the rotatable electric plug of FIG. 1, in accordance with the subject matter described herein.

FIG. 3 illustrates an isometric exploded left side view of an exemplary rotatable electric plug system 300 in accordance with one embodiment of the subject matter described herein. System 300 is merely exemplary and is not limited to embodiments presented herein. System 300 can be implemented in many different embodiments or examples not presented herein. Elements numbered as in FIGS. 1 and 2 above function in a substantially similarly way. In FIG. 3, rotatable electric plug head 110 includes top housing 111 having an opening that is disposed to contain rotatable plug assembly 130, and bottom housing 112 configured to mechanically couple to top housing 111. Top housing 111 and bottom housing 112 are coupled to form a cavity to at least partially contain rotatable plug assembly 130 as well as a connecting end portion of power cable 120. As described above, rotatable plug assembly 130 includes rotation plate 140 located within the cavity formed by top housing 111 and bottom housing 112, and further includes blade slots to accommodate the passage of associated blades of blade array 150. Rotation plate 140 is configured to slidably fit with the opening of top housing 111 and maintain rotatable plug assembly 130 within the cavity formed by top housing 111 and bottom housing 112. In one embodiment, the opening of top housing 111 is delimited by a housing flange, where the housing flange is complementary with a plate flange at the perimeter of rotation plate 140 to thereby restrict rotatable plug assembly 130 from exiting through the opening of top housing 111.

As described above, rotatable plug assembly 130 additionally includes blade array 150 having plug blades 151-153. Plug blades 151-153 are sized to be received through the associated blade slots located in the face of rotation plate 140, and configured such that a portion of each of blade in blade array 150 is retained within the cavity formed by top housing 111 and bottom housing 112. In some embodiments, plug blade 151 (e.g., a ground plug blade) further includes a plug link 154, plug blade 152 is mechanically coupled to a leaf spring contact 155 via a rivet 156, and plug blade 153 further includes a plug link 157. In these embodiments, plug links 154 and 157 and leaf spring contact 155 are slidably coupled to the associated concentric contacts of contact array 160 within rotatable plug assembly 130.

As described above, rotatable electric plug head 110 additionally includes contact array 160 having a plurality of concentric contacts. In some embodiments, the plurality of concentric contacts of contact array 160 are substantially circular with the largest of the concentric contacts of contact array 160 sized to fit within the cavity formed by top housing 111 and bottom housing 112. In an example and referring to FIG. 3, contact array 160 includes three (3) substantially circular concentric contacts. In FIG. 3, each concentric contact of contact array 160 is configured to slidably couple to and be in electrical communication with an associated plug blade of blade array 150. Additionally and further detailed in FIG. 4 below, each of the substantially circular concentric contacts of contact array 160 includes a corresponding tab oriented substantially perpendicular to its associated concentric contact and further oriented away from its concentric contact's associated plug blade of blade array 150. Although power cable 120 is illustrated above contact support 170 so as to illustrate mechanical coupling of its individual wires to the associated tabs of contact array 160, it should be understood that end of power cable 120 is located within the cavity created by contact support 170 and bottom housing 112 (detailed below).

In FIG. 3, rotatable electric plug head 110 further includes contact support 170 having a base and a sidewall that substantially conforms to fit within the cavity formed by top housing 111 and bottom housing 112, such as, for example, a circular sidewall that runs along the interior wall of bottom housing 112. In some embodiments, the base of contact support 170 is configured to receive the concentric contacts of contact array 160 and is further configured to provide electrical insulation between each of the contacts, such as, for example, via grooves configured within the base to accommodate the concentric contacts of contact array 160. Further to the embodiment, contact support 170 includes a plurality of positioning slots, each of the positioning slots configured to receive an associated tab of an associated concentric contact of contact array 160. In other embodiments, contact support 170 is configured to form an inner cavity opposite the surface of its base to receive a portion of cable 120 and to facilitate the coupling of wire leads of cable 120 to associated tabs of contact array 160, where the associated tabs access the inner cavity through the associated positioning slots of contact support 170.

In FIG. 3, rotatable electric plug head 110 additionally includes wave spring 180 located between the circular sidewall of contact support 170 and bottom housing 112. Wave spring 180 is configured to provide pressure to maintain contact between the concentric contacts of contact array 160 and the associated plug blades of blade array 150. The pressure is provided regardless of whether the plug blades of blade array 150 are in motion or are stationary relative to the concentric contacts of contact array 160.

Figure 4:
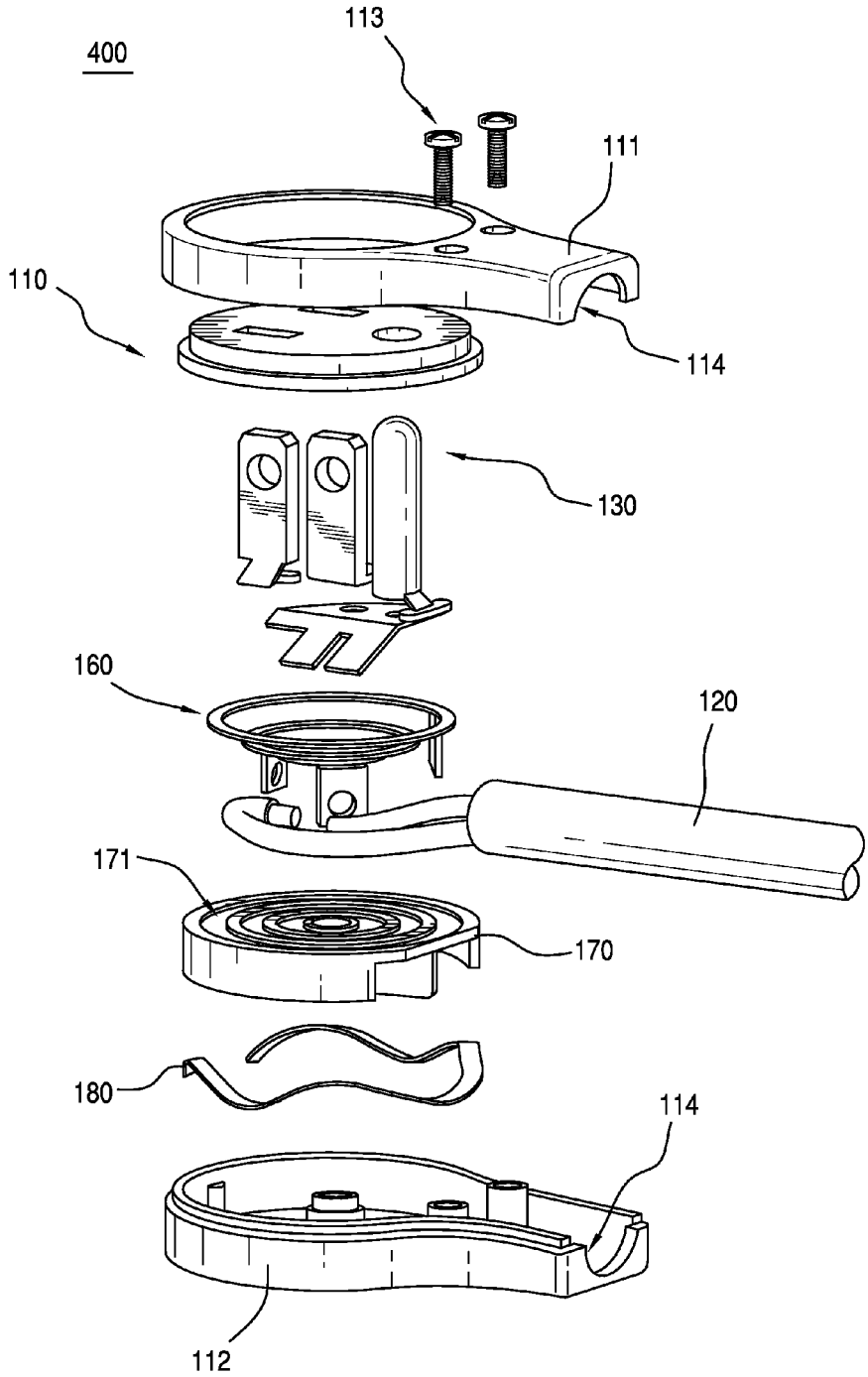
FIG. 4 illustrates an isometric exploded right side view of the rotatable electric plug of FIG. 1, in accordance with the subject matter described herein.

FIG. 4 illustrates an isometric exploded left side view of exemplary rotatable electric plug system 400 in accordance with one embodiment of the subject matter described herein. System 400 is merely exemplary and is not limited to embodiments presented herein. System 400 can be implemented in many different embodiments or examples not presented herein. Elements numbered as in FIGS. 1-3 above function in a substantially similarly way. In FIG. 4 and previously described above, rotatable electric plug head 110 includes contact support grooves 171 configured within the base of contact support 170 to accommodate the concentric contacts of contact array 160. Rotatable electric plug head 110 additionally includes screws 113 to provide mechanical coupling of top housing 111 to bottom housing 112. Additional methods for mechanically coupling top housing 111 to bottom housing 112 may be used, including, for example, ultrasonic welding, formed snaps, or solvent bonding attachment techniques. In FIG. 4, rotatable electric plug head 110 additionally includes strain relief 114 area within top housing 111 and bottom housing 112 that reinforce the end of power cable 120. In some embodiments, strain relief 114 within top housing 111 and bottom housing 112, which together enclose a portion of power cable 120, includes one or more sets of teeth within the slotted/cord areas where a portion of power cable 120 resides. In this embodiment, the teeth can secure power cable 120 within rotatable electric plug 110.

Figure 5:
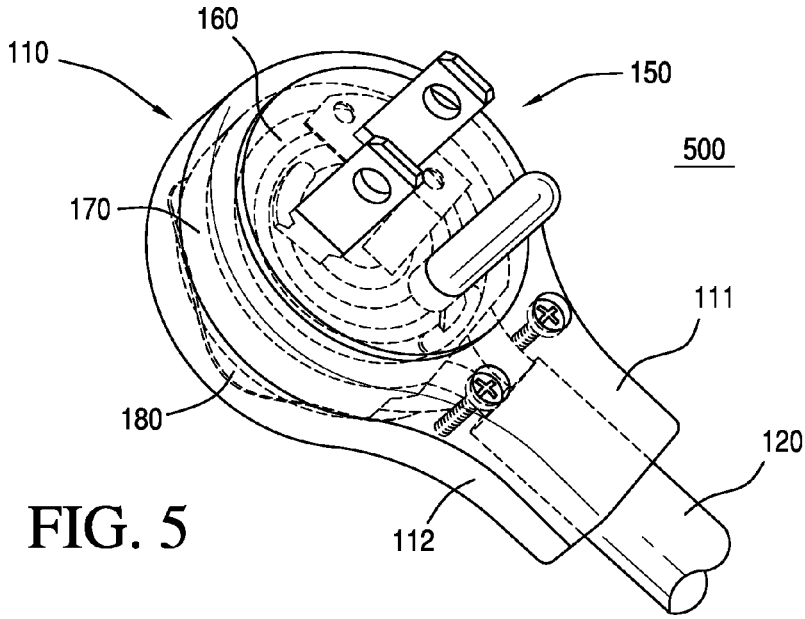
FIG. 5 illustrates an isometric translucent top view of the rotatable electric plug of FIG. 1, in accordance with the subject matter described herein.

FIG. 5 is a see-through isometric front view illustrating an exemplary embodiment of a rotatable electric plug system 500 in accordance with one embodiment of the subject matter described herein. System 500 is merely exemplary and is not limited to embodiments presented herein. System 500 can be implemented in many different embodiments or examples not presented herein. Elements numbered as in FIGS. 1-4 above function in a substantially similarly way. In FIG. 5, rotatable electric plug system 500 details the positioning of each of the blades within blade array 150 relative to each contact of contact array 160 that is slidably coupled to the base of contact support 170. In FIG. 5, rotation plate 140 has been removed for visual representation. In some embodiments, the base of contact support 170 receives the contacts of contact array 160, wherein all or a portion (e.g., the base) of contact support 170 is manufactured to have properties allowing portions of the contacts of contact array 160 to be received within the base, thereby providing electrical insulation between each of the contacts of contact array 160.

Figure 6:
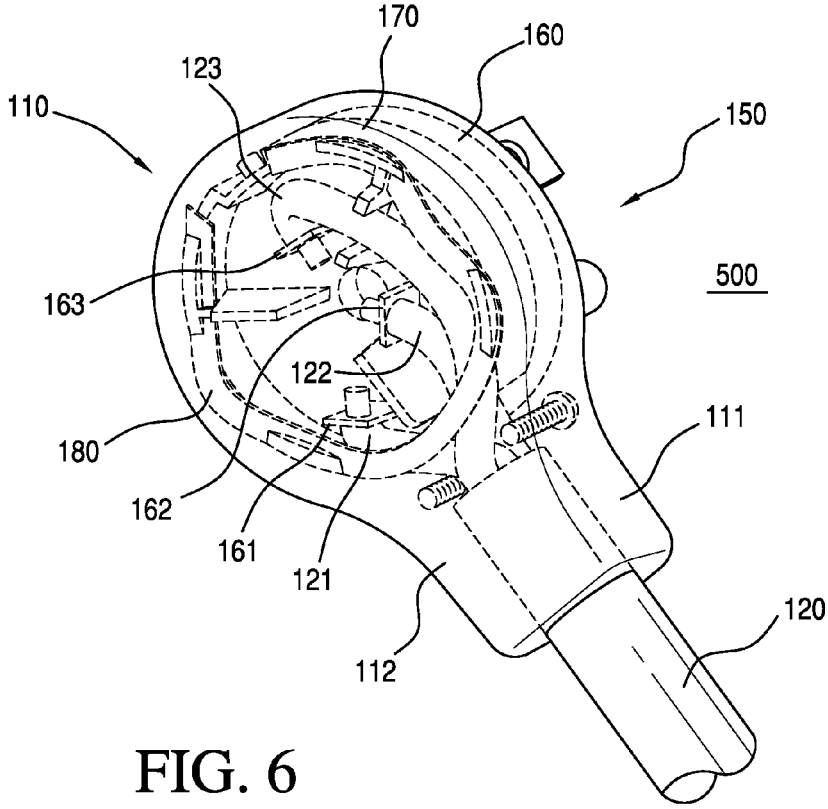
FIG. 6 illustrates an isometric translucent bottom view of the rotatable electric plug of FIG. 1, in accordance with the subject matter described herein.

FIG. 6 is a see-through isometric front view illustrating an exemplary embodiment of a rotatable electric plug system 600 in accordance with one embodiment of the subject matter described herein. System 600 is merely exemplary and is not limited to embodiments presented herein. System 600 can be implemented in many different embodiments or examples not presented herein. Elements numbered as in FIGS. 1-5 above function in a substantially similarly way. In FIG. 6, tabs (161-163) associated with concentric contacts of contact array 160 extend through positioning slots (not shown) within contact support 170 and are mechanically coupled to and in electrical communication with individual wire leads (121-123) of power cable 120. In some embodiments, the cavity formed by contact support 170 and bottom housing 112 (removed for visual reference) includes interior walls to provide spatial insulation and a physical barrier between each wire lead (121-123) of power cable 120 and its mechanical coupling to an associated tab (e.g., tab 161) of contact array 160 and the other wire lead/tab (e.g., tabs 162 and 163) mechanical couplings.

In some embodiments, top housing 111, rotation plate 140, contact support 170, and bottom housing 112 can be manufactured from any suitable flame-rated materials, such as, for example, flame-rated acrylonitrile butadiene styrene (ABS) plastic, as available from GE Plastics of Pittsfield, Mass. In addition, top housing 111, rotation place 140, contact support 170, and bottom housing 112 can be manufactured from other rigid or semi-rigid flame-rated thermoplastic materials, such as, for example, flame-rated polycarbonate plastic or polystyrene plastic. In other embodiments, plug blades 151-153 of blade array 150 and the concentric contacts of contact array 160 can be manufactured from any suitable electrically conducting material, such as, for example, copper alloys including brass and bronze alloys.

In other embodiments, the rotatable electric plug includes a cable stop. In this embodiment, a cable stop is configured to fit within a slotted area of bottom housing 112 and significantly reduce the movement of power cable 120 that is coupled to rotatable electric plug 110. In still other embodiments, rotatable electric plug 110 does not include ground plug blade 151 as part of blade array 150. In this embodiment, the concentric contacts of contact array 160 do not have three concentric rings, but instead have two concentric rings, and the base of contact support 170 is also modified accordingly. In this embodiment, each of plug blades (152 and 153) of plug array 150 can optionally have different sizes, particularly in an embodiment where the plug blades (152 and 153) of plug array 150 are polarized, so that plug blades (152 and 153) of plug array 150 couple to an electrical outlet in a specific orientation.

Figure 7:
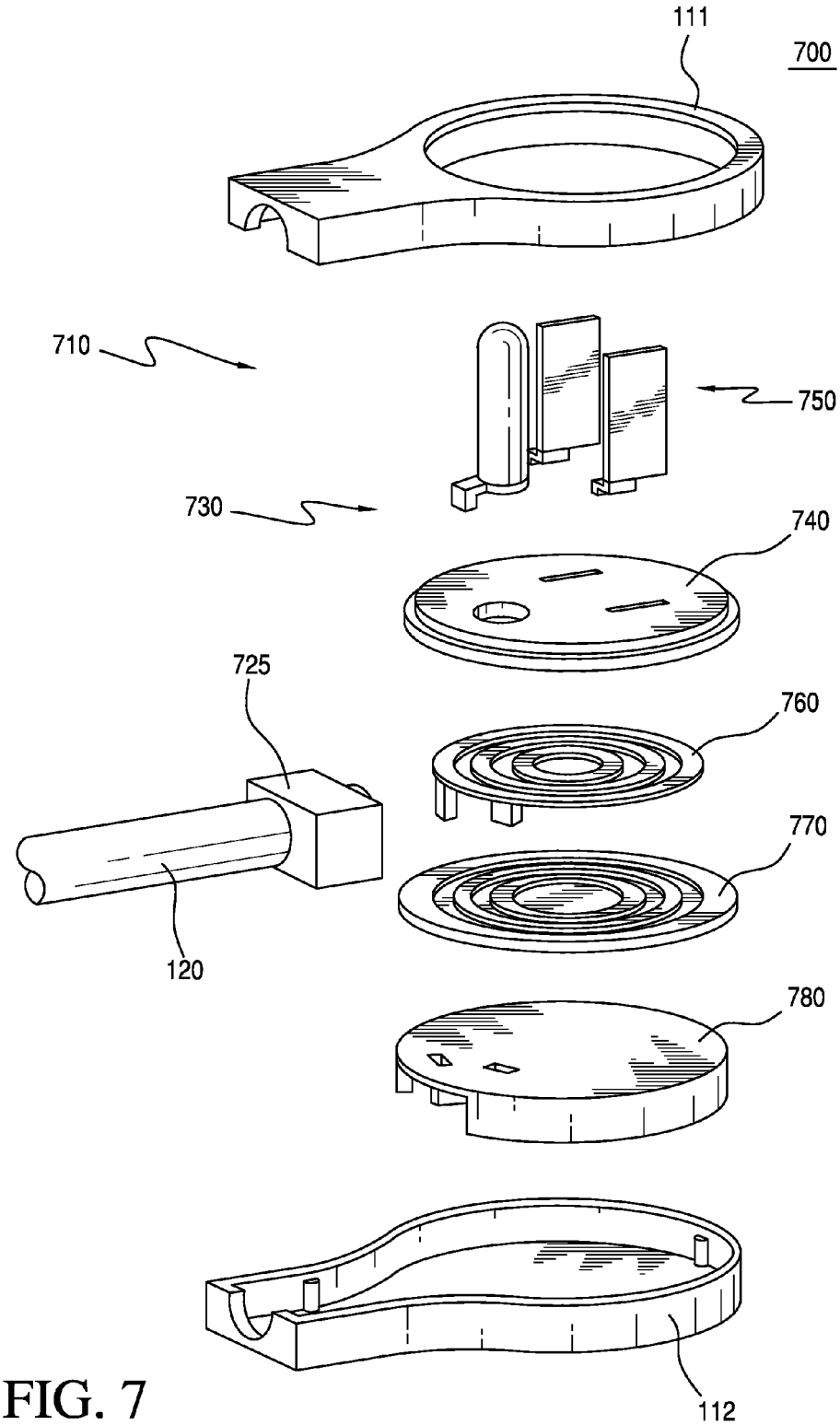
FIG. 7 illustrates an isometric exploded right side view of another embodiment of a rotatable electric plug, in accordance with the subject matter described herein.

FIG. 7 illustrates an isometric exploded left side view of an exemplary rotatable electric plug system 700 in accordance with another embodiment of the subject matter described herein. System 700 is merely exemplary and is not limited to embodiments presented herein. System 700 can be implemented in many different embodiments or examples not presented herein. Elements numbered as in FIGS. 1-6 above function in a substantially similarly way. In FIG. 7, rotatable electric plug head 710 includes top housing 111 having an opening disposed to contain the rotatable plug assembly, bottom housing 112 and a cable stop 725 configured to fit within a slotted area of bottom housing 112 and be coupled to power cable 120 to significantly reduce movement of power cable 120 coupled to rotatable electric plug head 710. Each of top housing 111 and bottom housing 112 is configured to mechanically couple to the other and form a cavity between them.

In FIG. 7, rotatable electric plug head 710 additionally includes a rotatable plug assembly 730 having a rotation plate 740 and a blade array 750. Rotation plate 740 is located within the cavity and includes a face having blade openings for receiving blades. Additionally, rotation plate 740 is configured to slidably fit within the opening of top housing 111 and maintain rotatable plug assembly 730 within the cavity formed by top housing 111 and bottom housing 112. In some embodiments, top housing 111 is configured to include a flange along the inside opening and the flange is configured to include a complementary configuration to an associated recess at the perimeter of rotation plate 740.

Blade array 750 includes two (2) plug blades sized to be received through two of the blade openings within the face of rotation plate 740. The blades of blade array 750 are sized so that a portion of each blade is retained within the cavity. Blade array 750 additionally includes a ground plug blade sized to be received through a blade opening within the face of rotation plate 740. The ground plug blade of blade array 750 is sized so that a portion of the ground plug blade is retained within the cavity.

In FIG. 7, rotatable electric plug head 710 further includes a contact array 760 having a set of concentric contacts where the largest of the concentric contacts is sized to fit within the cavity formed by top housing 111 and bottom housing 112, and each of the concentric contacts of contact array 760 are configured to be in mechanical and electrical communication with an associated blade of blade array 750. Rotatable electric plug head 710 additionally includes a pliable contact pad 770 configured to receive contact array 760 and provide electrical insulation between each of the contacts (detailed in FIG. 8, below) as well as provide sufficient pressure to maintain contact between the concentric contacts of contact array 760 and the associated blades of blade array 750 when the blades of blade array 750 are stationary and when the blades of blade array 750 are moving. In FIG. 7, rotatable electric plug head 710 additionally includes a pliable pad support 780 configured to receive pliable contact pad 770 and provide sufficient additional pressure, if necessary, to maintain contact between the concentric contacts of contact array 760 and the associated blades of blade array 750 when the blades of blade array 750 are stationary and when the blades of blade array 750 are moving.

In some embodiments, top housing 111, bottom housing 112 and pliable pad support 780 including positioning slots, of rotatable electric plug head 710, are manufactured using an injection molding process. In other embodiments, the plug blades of blade array 750 are stamped and formed so as to pass through rotation plate 740 with a portion of the plug blades of blade array 750 remaining within the rotatable plug assembly 730 area. In still other embodiments, the plug blades of blade array 750 are inserted into an injection mold and rotation plate 740 is formed fixing the plug blades of blade array 750 into rotation plate 740.

In yet other embodiments, pliable contact pad 770, including positioning slots, is formed via a thermal set molding and pliable contact pad 770 is placed on pliable pad support 780 forming a contact support subassembly. In this embodiment, the positioning slots (not shown) of pliable pad support 780 and pliable contact pad 770 are aligned. The concentric contacts of contact array 760 are manufactured using any suitable method, such as, for example stamping and forming of the concentric contacts of contact array 760 into concentric shapes and including tabs for extending through the positioning slots within pliable contact pad 770 and pliable pad support 780. In this embodiment, the three wires of power cable 120 are then attached to the tabs of the concentric contacts of contact array 760 that protrude though the positioning slots of pliable pad support 780 portion of the contact support subassembly forming a contact support assembly.

Power cable 120 and the attached contact support assembly are then placed into bottom housing 112. Rotation plate 740, including the attached plug blades of blade array 750, is placed into top housing 111. Top housing 111 and bottom housing 112 are fitted and secured together, such as, for example by screws, ultrasonic welding, formed snaps, or solvent bonding attachment techniques.

Advantages of rotatable electric plug head 710 include rotation plate 740 having mounted plug blades of blade array 750, where the plug blades of blade array 750 have integrated contacts, and pliable pad 770 provides electrical insulation between the individual concentric contacts of contact array 760 and maintains contact between the plug blades of blade array 750 and each associated concentric contact of contact array 760.

Figure 8:
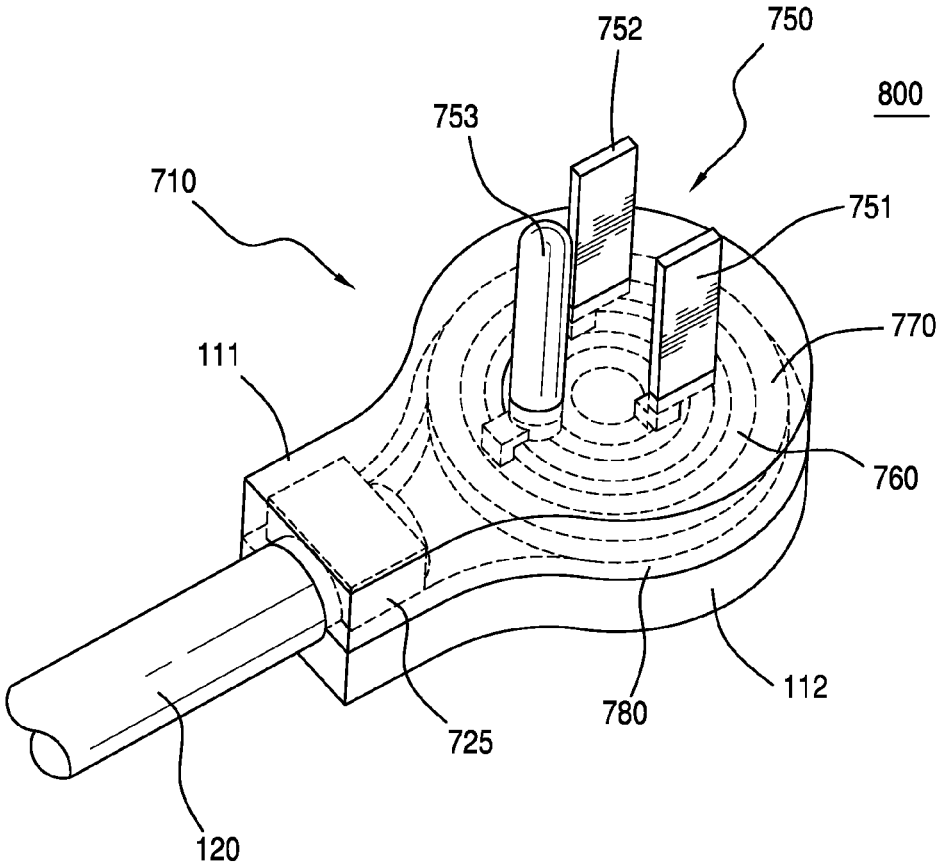
FIG. 8 illustrates a cutaway isometric top view of the rotatable electric plug of FIG. 7, in accordance with the subject matter described herein.

FIG. 8 is a cutaway isometric view illustrating an embodiment of an exemplary rotatable electric plug system 800 in accordance with one embodiment of the subject matter described herein. System 800 is merely exemplary and is not limited to embodiments presented herein. System 800 can be implemented in many different embodiments or examples not presented herein. Elements numbered as in FIG. 7 above function in a substantially similarly way. In FIG. 8, rotatable electric plug system 800 illustrates potential positioning of plug blades (751 and 752) and ground plug blade 753 relative to each concentric contact of contact array 760, as well as illustrating potential interaction between pliable contact pad 770 and each concentric contact of contact array 760. In this embodiment, pliable contact pad 770 is illustrated as receiving the concentric contacts of contact array 760. Additionally, because pliable contact pad 770 is manufactured to have properties allowing portions of pliable contact pad 770 to reposition between each of the concentric contacts of contact array 760, pliable contact pad 770 provides electrical insulation between each of the concentric contacts of contact array 760. In this embodiment, pliable pad support 780 provides support for pliable contact pad 770. Further to this embodiment, cable stop 725 is located within a slotted area of bottom housing 112 and provides significantly reduced movement of power cable 120 when coupled to the rotatable electric plug head 710.

Figure 9:
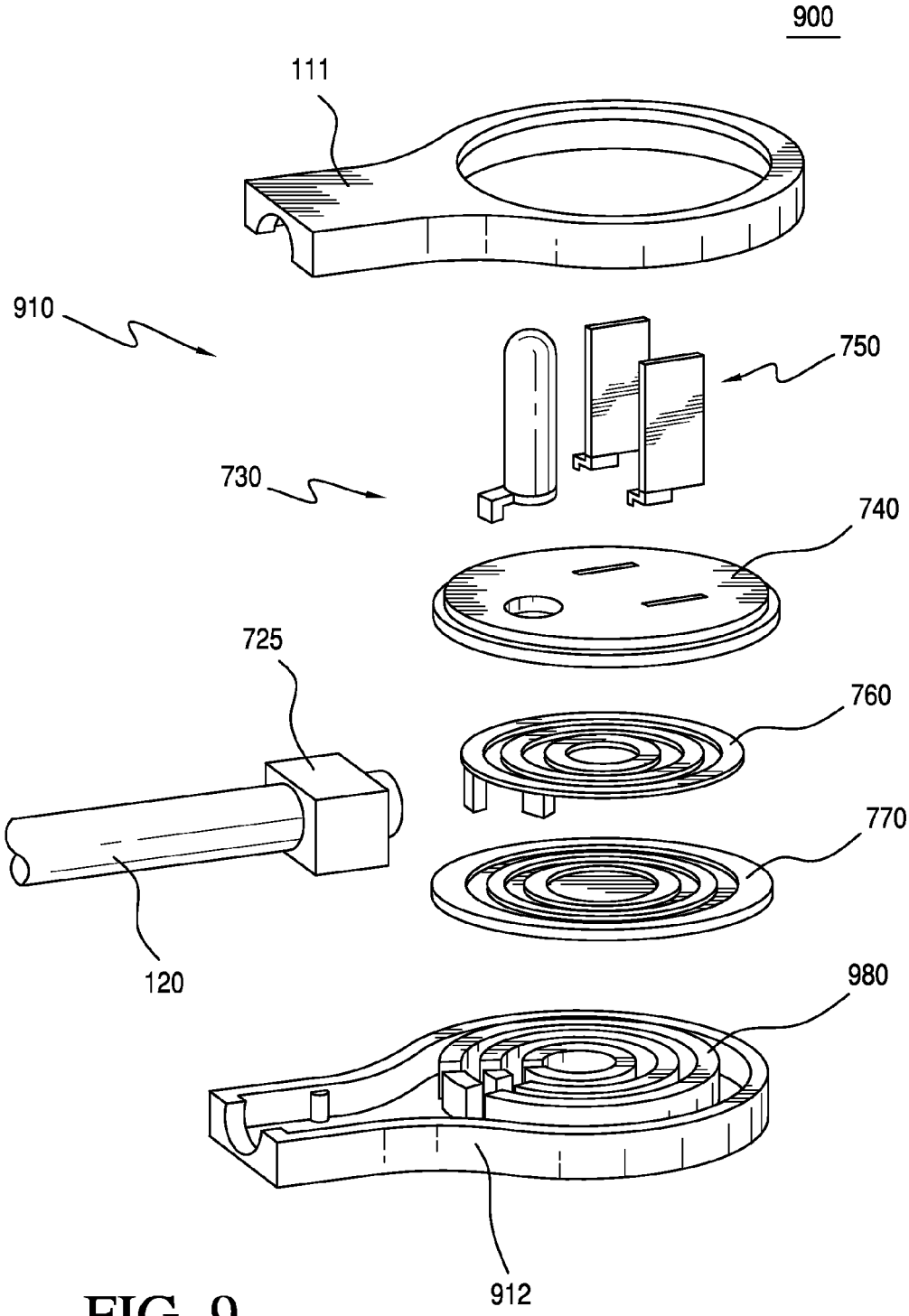
FIG. 9 illustrates an isometric exploded right side view of yet another embodiment of a rotatable electric plug, in accordance with the subject matter described herein.

FIG. 9 illustrates an isometric exploded left side view of an exemplary rotatable electric plug system 900 in accordance with another embodiment of the subject matter described herein. System 900 is merely exemplary and is not limited to embodiments presented herein. System 900 can be implemented in many different embodiments or examples not presented herein. Elements numbered as in FIGS. 1-8 above function in a substantially similarly way. In FIG. 9, pliable pad support 780 and bottom housing 112 of FIG. 7 are replaced with a modified bottom housing 912 including formed ribs 980 configured to provide the functionality of the pad support 780 of FIG. 7, above. In one embodiment, modified bottom housing 912 can be manufactured using an injection molding process.

In FIGS. 7-9, top housing 111, rotation plate 740, pliable contact pad 770, pad support 780, and bottom housings 112 and 912 can be manufactured from any suitable flame-rated materials, such as, for example, flame-rated acrylonitrile butadiene styrene (ABS) plastic, as available from GE Plastics of Pittsfield, Mass. In addition, top housing 111, rotation plate 740, pliable contact pad 770, pad support 780, and bottom housings 112 and 912 can be manufactured from other rigid or semi-rigid flame-rated thermoplastic materials, such as, for example, flame-rated polycarbonate plastic or polystyrene plastic. In other embodiments, plug blades of blade array 750 and concentric contacts of contact array 760 can be manufactured from any suitable electrically conducting material, such as, for example, copper alloys including brass and bronze alloys.

In a different embodiment, the rotatable electric plug heads 710 and 910 do not include cable stop 725. In this embodiment, top housing 111 and/or bottom housings 112 and 912 can optionally have one or more teeth within the slotted areas of top housing 111 and/or bottom housings 112 and 912. Said teeth can secure cable 120 within the rotatable electric plug head. In the same or different embodiment, rotatable electric plug heads 710 and 910 do not include a ground plug blade. In these embodiments, the concentric contacts of contact array 160 do not have three concentric rings, but instead have two concentric rings, and pliable contact pad 770, pad support 780, and/or bottom housing 112 are also modified accordingly. Furthermore, in these embodiments, each of the plug blades of blade array 750 can optionally have different sizes, particularly in an embodiment where the plug blades of blade array 750 are polarized, so that plug the blades of blade array 750 couple to an electrical outlet in a specific orientation.

Figure 10:
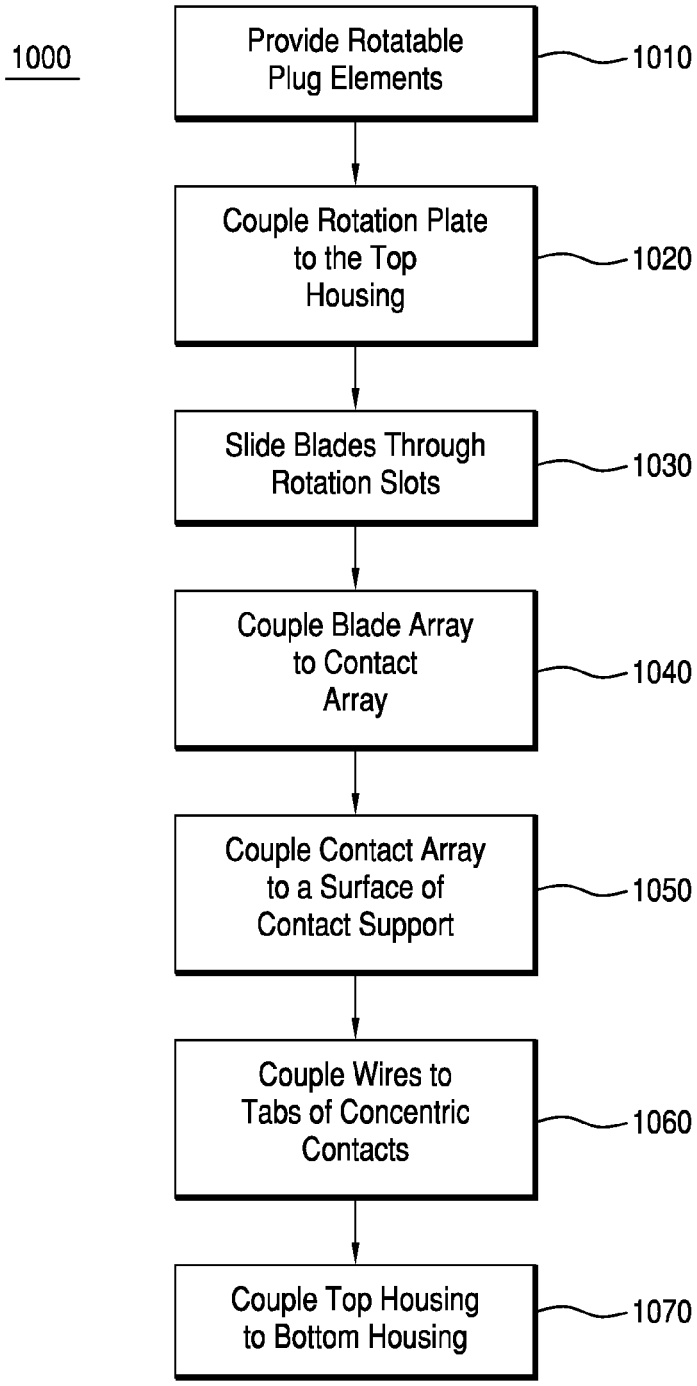
FIG. 10 is a flow chart illustrating an example of a procedure of providing a rotatable electric plug.

FIG. 10 illustrates an example of a method 1000 of providing a rotatable assembly. Method 1000 is merely exemplary and is not limited to embodiments presented herein. Method 1000 can be implemented in many different embodiments or examples not presented herein.

Method 1000 of FIG. 10 includes a procedure 1010 of providing rotatable plug elements. The rotatable plug elements can include: a top housing, a bottom housing, a contact support, a contact array, a blade array, a rotation plate, and a power cord. The top housing can be the same as or similar to top housing 111 (FIGS. 1-9); the bottom housing can be the same as or similar to bottom housing 112 (FIGS. 1-8) or bottom housing 912 (FIG. 9); the contact support can be the same as or similar to contact support 170 (FIGS. 3-6) or contact pad 770 (FIGS. 7-9); the contact array can be the same as or similar to contact array 160 (FIGS. 3-6) or contact array 760 (FIGS. 7-9); the blade array can be the same as or similar to blade array 150 (FIGS. 3-6) or blade array 750 (FIGS. 7-9); the rotation plate can be the same as or similar to rotation plate 140 (FIGS. 1 and 3-6) or rotation plate 740 (FIG. 7-9); and the power cable can be the same as or similar to power cable 120 (FIGS. 1-9).

Next, method 1000 continues with a procedure 1020 of coupling the rotation plate to the top housing. In some embodiments, a top surface of the rotation plate is configured to engage an opening in the top housing. In such an embodiment, the top surface of the rotation plate will be visible through an exterior surface of the top housing.

Subsequently, method 1000 has a procedure 1030 of sliding blades of the blade array though rotation slot of the rotation plate. The blades of the blade array can be similar to or the same as blades 151-153 (FIG. 3). In some embodiments, the rotation plate has a separate slot for each of the blades of the blade array. Therefore, each blade is slid into its corresponding slot in the rotation plate.

After procedure 1030, method 1000 continues with a procedure 1040 of coupling the blade array to the contact array. In some embodiments, the coupling of the blade array to the contact array comprises coupling the blade array so that it is in slidable communication with the contact array. Furthermore, in the same or other embodiments, each of the blades of the blade array is in electrical communication with a separate concentric contact of the contact array.

Next, method 1000 continues with a procedure 1050 of coupling the contact array to a surface of the contact support. In some embodiments, each of the separate concentric contacts of the contact array comprises a tab. Each of the tabs of the concentric contacts can pass through a separate slot in the contact support. As an example, the tabs can be the same as or similar to tabs 161-163 (FIG. 6). In the same or different embodiment, procedure 1050 can include positioning the contact array over the contact support.

Then, method 1000 has a procedure 1060 of coupling each wire of the power cable to a separate tab of the concentric contacts. As an example, the wires of the power cable can be the same as or similar to wire leads 121-123 (FIG. 6). The wires can be coupled to the tabs using any method of coupling.

After procedure 1060, method 1000 continues with a procedure 1070 of coupling the top housing to the bottom housing. Any method may be used to couple the top housing to the bottom housing. For example, the top housing and the bottom housing can be coupled using ultrasonic welding, formed snaps, or solvent bonding. In another example, screws are used to couple the top housing to the bottom housing. As an example, the screws can be the same as or similar to screws 113 (FIG. 4). In some embodiments, after the top housing and the bottom housing are coupled, an opening is created between the first housing and the second housing. In such embodiments, the power cable can pass through this opening.

Although FIG. 10 illustrated various procedures of method 1000, it will be understood by those skilled in the art that various changes can be made to method 1000 without departing from the scope of the invention. For instance, the order of the procedures can be altered. As one example, procedure 1030 can occur before procedure 1020; procedure 1040 can occur before procedure 1030; procedure 1050 can occur before procedure 1040; and/or procedure 1060 can occur before procedure 1050. As another example, not all the plug elements described in reference to procedure 1010 above need to be provided at one time. It is possible that the power cable may not be provided until procedure 1060 is being performed.

In addition, additional procedures can be added to method 1000. For example, method 1000 can include a procedure of providing a pressure mechanism. The pressure mechanism can be used to provide pressure to maintain contact between the concentric contacts of the contact array and the blades of the blade array. As an example, the pressure mechanism can be the same as or similar to wave spring 180 (FIGS. 3-6) As best seen in FIG. 6, pressure mechanism 160 can be coupled to the contact support 170, between contact support 170 and bottom housing 112. In another example, pressure mechanism can be the same as or similar to pliable pad support 780 (FIG. 7-9). In this example, pliable pad support 780 is coupled contact pad 770 between contact pad 770 and bottom housing 112 (or 912 if FIG. 9).

Although aspects of the subject matter described herein have been described with reference to specific embodiments, it will be understood by those skilled in the art that various changes may be made without departing from the scope of the subject matter described herein. Accordingly, the disclosure of embodiments is intended to be illustrative of the scope of the subject matter described herein and is not intended to be limiting. It is intended that the scope of the subject matter described herein shall be limited only to the extent required by the appended claims. To one of ordinary skill in the art, it will be readily apparent that the devices and method discussed herein may be implemented in a variety of embodiments, and that the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

All elements claimed in any particular claim are essential to the subject matter described herein and claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A rotatable electric plug, comprising:

a housing having:

a top piece having an interior surface and an exterior surface and including a first opening;

a bottom piece having an interior surface and an exterior surface, the bottom piece in mechanical communication with the top piece and forming a first cavity defined by the interior surface of the top piece and the interior surface of the bottom piece, the first cavity including a second opening;

a contact support subassembly having a top surface and a bottom surface and located within the first cavity and having a third opening in communication with the bottom surface, the contact support subassembly mechanically coupled to the interior surface of the bottom piece and forming a second cavity in communication with the third opening, the top of the contact support subassembly including a plurality of contact support subassembly slots;

a contact array in mechanical communication with the top surface of the contact support subassembly, the contact array including a plurality of concentric contacts, each one of the plurality of concentric contacts including a tab passing through an associated one of the plurality of contact support subassembly slots;

a blade array in slidable communication with the contact array, the blade array including a plurality of blades, each blade of the plurality of blades in electrical communication with an associated one of the plurality of concentric contacts of the contact array;

a rotation plate having a top surface and a bottom surface, the top surface of the rotation plate sized to fit within the first opening, the rotation plate including a plurality of rotation slots, each rotation slot of the plurality of rotation slots sized to receive an associated one of the plurality of blades of the blade array; and a power cord configured to pass through the second opening into the first cavity and to further pass through the third opening into the second cavity, the power cord having a plurality of wires, each wire of the plurality of wires configured to mechanically couple to and be in electrical communication with an associated one of the tabs of the plurality of concentric contacts.

2. The rotatable electric plug of claim 1, wherein the contact support subassembly comprises a contact support and a spring, the contact support having a base configured as the top surface of the contact support subassembly and a sidewall, the base and the sidewall defining the second cavity and the third opening, the spring positioned along the sidewall between the contact support and the interior surface of the bottom piece.

3. The rotatable electric plug of claim 2, wherein the spring is a wave spring.

4. The rotatable electric plug of claim 2, wherein the base includes contact support grooves configured to receive the plurality of concentric contacts of the contact array.

5. The rotatable electric plug of claim 1, wherein the contact support subassembly includes a pliable pad support and a pliable contact pad, the pliable pad support having a base configured as the top surface of the contact support subassembly and a sidewall, the base and the sidewall defining the second cavity and the third opening, the pliable contact pad positioned between the base and the contact array.

6. The rotatable electric plug of claim 5, wherein the pliable contact pad includes contact support grooves configured to receive the plurality of concentric contacts of the contact array.

7. The rotatable electric plug of claim 1, wherein the contact support subassembly includes a partition array and a pliable contact pad, the partition array including a plurality of barriers, each barrier having a top and a bottom, the bottoms of the barriers mechanically coupled to the interior surface of the bottom piece, the pliable contact pad mechanically coupled to the tops of the barriers and positioned between the barriers and the contact array.

8. The rotatable electric plug of claim 7, wherein the pliable contact pad includes contact support grooves configured to receive the plurality of concentric contacts of the contact array.

9. The rotatable electric plug of claim 8, wherein the barriers of the partition array are configured to allow the portions of the pliable contact pad located directly under the contact support grooves of the pliable contact pad to reside in spaces between the barriers.

10. The rotatable electric plug of claim 9, wherein the barriers of the partition array are integral with the interior surface of the bottom piece.

11. The rotatable electric plug of claim 1, wherein the plurality of concentric contacts are circular.

12. The rotatable electric plug of claim 1, wherein the blade array comprises two blades and the plurality of concentric contacts comprises two concentric contacts.

13. The rotatable electric plug of claim 1, wherein the blade array comprises three blades and the plurality of concentric contacts comprises three concentric contacts.

14. The rotatable electric plug of claim 1, wherein the first opening of the top piece is substantially circular and the rotation plate is configured as a substantially circular rotation plate having at least one diameter substantially similar to a diameter of the first opening of the top piece.

15. The rotatable electric plug of claim 14, wherein the first opening of the top piece comprises a flange defining the first opening and the rotation plate comprises a recess at its perimeter defining the perimeter of the top surface of the rotation plate.

16. A rotatable electric plug, comprising:

an electrically insulative top shell, the top shell including a circular opening;

an electrically insulative bottom shell mechanically coupled to the electrically insulative top shell, the coupling of the electrically insulative top shell and the electrically insulative bottom shell forming an interior cavity and a power cable hole;

subassembly means within the cavity, the subassembly means in mechanical communication with the electrically insulative bottom shell and configured to receive a power cable and facilitate the coupling of the power cable to electrical contacts within the interior cavity;

electrical contact means mechanically coupled to the subassembly means, the electrical contact means including the electrical contacts, wherein the electrical contacts are mechanically coupled to and in electrical communication with the power cable;

blade means slidably coupled to and in electrical communication with the electrical contact means;

a rotation plate having a top surface and a bottom surface, the top surface or the rotation plate sized to fit within the circular opening, the rotation plate including a plurality of rotation slots, each slot of the rotation plate sized to receive a portion of a different one of the blade means; and the power cable configured to pass through the power cable hole into the subassembly means and to couple with the electrical contact means.

17. A method of providing a rotatable electric plug, comprising:

providing a top housing, a bottom housing, a contact support, a contact array, a blade array, a rotation plate, and a power cord;

coupling the rotation plate to the to the top housing so that a top surface of the rotation plates is configured to fit into a first opening of the top housing;

sliding blades of the blade array through rotation slots in the rotation plate;

coupling the blade array with the contact array, wherein:

the blade array is in slidable communication with the contact array; and each of the blades of the blade array is in electrical communication with a different one of a plurality of concentric contacts of the contact array;

coupling the contact array to a top surface of the contact support;

coupling each wire of the power cord to a tab of a different one of the plurality of concentric contacts of the contact array; and coupling the top housing to the bottom housing.

18. The method of claim 17, wherein:

coupling the contact array to the top surface of the contact support comprises sliding each of the tabs of the plurality of concentric contacts of the contact array through a separate slot in the contact support.

19. The method of claim 17, wherein:

coupling the top housing to the bottom housing comprises forming a second opening between the top housing and the bottom housing; and the power cable is located in the second opening.

20. The method of claim 17, further comprising:

providing a pressure mechanism configured to provide pressure to maintain contact between the plurality of concentric contacts of the contact array and the blades of the blade array.

* * * * *

UNITED STATES PATENT AND TRADEMARK OFFICE

CERTIFICATE OF CORRECTION

PATENT NO. : 7,914,292 B2
APPLICATION NO. : 12/581110
DATED : March 29, 2011
INVENTOR(S) : Dale T. Honda It is certified that error appears in the above-identified patent and that said Letters Patent is hereby corrected as shown below:

At column 11, line 59, delete “and”
At column 11, line 59, insert --and-- after the “;”
At column 12, line 37, insert --and-- after the “,”
At column 12, line 49, insert --and-- after the “,”
At column 12, line 57, delete “a plurality of”
At column 12, line 58, delete “barrier” and insert --of the barriers-- between “each” and “having”
At column 12, line 60, insert --and-- after the “,”
At column 13, line 02, delete “the” between “allow” and “portions”
At column 14, line 15, delete “to the” before “to the”

Signed and Sealed this
Twenty-eighth Day of June, 2011

David J. Kappos

David J. Kappos
*Director of the United States Patent and Trademark Office*